US007314436B1

(12) United States Patent
Rubin

(10) Patent No.: US 7,314,436 B1
(45) Date of Patent: Jan. 1, 2008

(54) EXERCISE DEVICE

(76) Inventor: Bruce Rubin, 120 Lucerne Blvd., Cherry Hill, NJ (US) 08003

( * ) Notice: Subject to any disclaimer, the term of this patent is extended or adjusted under 35 U.S.C. 154(b) by 0 days.

(21) Appl. No.: 11/491,752

(22) Filed: Jul. 24, 2006

Related U.S. Application Data

(63) Continuation-in-part of application No. 11/053,768, filed on Feb. 9, 2005, now Pat. No. 7,081,074.

(51) Int. Cl.
*A63B 21/00* (2006.01)

(52) U.S. Cl. ..... 482/92; 482/146; 482/147; 473/131

(58) Field of Classification Search ..... 482/34, 482/146–147; D21/733–759, 686, 662; 273/317.2; 473/131
See application file for complete search history.

(56) References Cited

U.S. PATENT DOCUMENTS

| | | | | |
|---|---|---|---|---|
| 1,585,748 | A | 5/1926 | Wendelken | |
| 3,784,193 | A | 1/1974 | Simjian | |
| 3,911,907 | A | 10/1975 | Smith, Jr. | |
| 4,305,579 | A | 12/1981 | Rice | |
| 4,456,245 | A | 6/1984 | Baldwin | |
| 4,629,181 | A | 12/1986 | Krive | |
| 4,673,180 | A | 6/1987 | Rice | |
| 5,352,176 | A | 10/1994 | Huang | |
| 5,632,711 | A | 5/1997 | Hwang | |
| 5,695,439 | A | 12/1997 | Lin | |
| 5,941,807 | A | 8/1999 | Cassidy et al. | |
| 6,244,994 | B1 | 6/2001 | Tilberis | |
| 6,875,159 | B2 | 4/2005 | Chuang | |
| 7,081,074 | B1 * | 7/2006 | Rubin | 482/146 |
| 7,118,519 | B2 * | 10/2006 | Slowinski | 482/146 |

* cited by examiner

*Primary Examiner*—Lori Amerson
(74) *Attorney, Agent, or Firm*—Norman E. Lehrer

(57) ABSTRACT

An exercise device having a first base member with foot platforms mounted thereon for rotating a person's lower body and a second base member including at least one handle to be grasped by a person for rotating a person's upper body. The first and second base members are mounted so as to be capable of rotating about the same vertical axis. Resistance means and/or weights may be used to increase the force needed to rotate the base members. Either base member may also be fixed so as not to rotate. Similarly, the foot platforms may rotate on the first base member independently of the first base member or can be fixed thereto so as to remain stationary in relation to the first base member. The second base member may be mounted adjacent the first base member and concentric therewith the handle extending upwardly.

21 Claims, 4 Drawing Sheets

36
34
32
30
112
10
28
108
110
6
14
24
20
12
6
5
26
106
18
5
22
90
98
16

EXERCISE DEVICE

CROSS REFERENCE TO RELATED APPLICATION

This application is a Continuation-in-Part of prior U.S. application Ser. No. 11/053,768, filed Feb. 9, 2005, now U.S. Pat. No. 7,081,074.

BACKGROUND OF THE INVENTION

The present invention is directed toward an exercise device and more particularly, toward an exercise device that provides a full body workout using rotary motion. The invention is particularly useful for engaging in an exercise that simulates the swinging of a baseball bat or a tennis racquet or the like.

Numerous types of exercise machines are available and are used by individuals at home, in gyms, health clubs, fitness centers, rehabilitation centers, and the like, in order to exercise or rehabilitate different parts of the body. For example, elliptical machines, rowing machines, climbing machines, stationary bikes, and treadmills, to name a few, are some of the machines commonly used. All of these machines, however, encourage movement along the body's sagittal plane. While these machines are effective, they do not utilize movement in the body's transverse plane through a full range of motion, or provide a means for improving a person's rotational balance.

Other machines are available that provide a rotary movement of the upper and lower body. For example, U.S. Pat. No. 6,875,159 to Chuang discloses a rotating platform upon which a person stands and includes one or more rotating foot disks. A handle may be mounted to and coupled to the platform. However, the handle and platform do not rotate about the same axis. Nor do they rotate independently of one another. Thus, the Chuang device appears to be somewhat limited in its function and does not allow a person to exercise a wide enough range of motion or develop rotational balance.

Therefore, a need exists for an exercise machine that provides rotary motion of the upper and lower body independently through a full range of motion.

SUMMARY OF THE INVENTION

The present invention is designed to overcome the deficiencies of the prior art discussed above. It is an object of the present invention to provide an exercise device that uses rotary motion in order to provide a full body workout through a full range of motion. It is another object of the invention to allow a person's upper body and lower body to work independently to help develop greater rotational balance. It is an even further object of the invention to provide an exercise device that includes a handle resembling a baseball bat so as to simulate the swinging of a baseball bat while the user is exercising.

In accordance with the illustrative embodiments demonstrating features and advantages of the present invention, there is provided an exercise device having a base, means for rotating a person's lower body and means for rotating a person's upper body. The means for rotating the person's lower body includes two foot disks and a first base member. The first base member, located adjacent the base, is mounted for rotation about a vertical axis but could be fixed in various rotational positions so as to remain stationary. The foot disks are mounted on the base member so as to be able to rotate on the first base member independently thereof. The foot disks may also remain stationary in relation to the first base member. The means for rotating the person's upper body includes a second base member located adjacent to the first base member, mounted for rotation about the same vertical axis as said first base member and includes one or more handles that extend to be grasped by the person exercising. The first and second base members may rotate independently of each other. Resistance and/or weights may be applied to either or both of the base members.

Other objects, features, and advantages of the invention will be readily apparent from the following detailed description of the preferred embodiments thereof taken in conjunction with the drawings.

BRIEF DESCRIPTION OF THE DRAWINGS

For the purpose of illustrating the invention, there is shown in the drawings forms that are presently preferred; it being understood that the invention is not intended to be limited to the precise arrangements and instrumentalities shown.

DETAILED DESCRIPTION OF THE PREFERRED EMBODIMENTS

Figure 1:
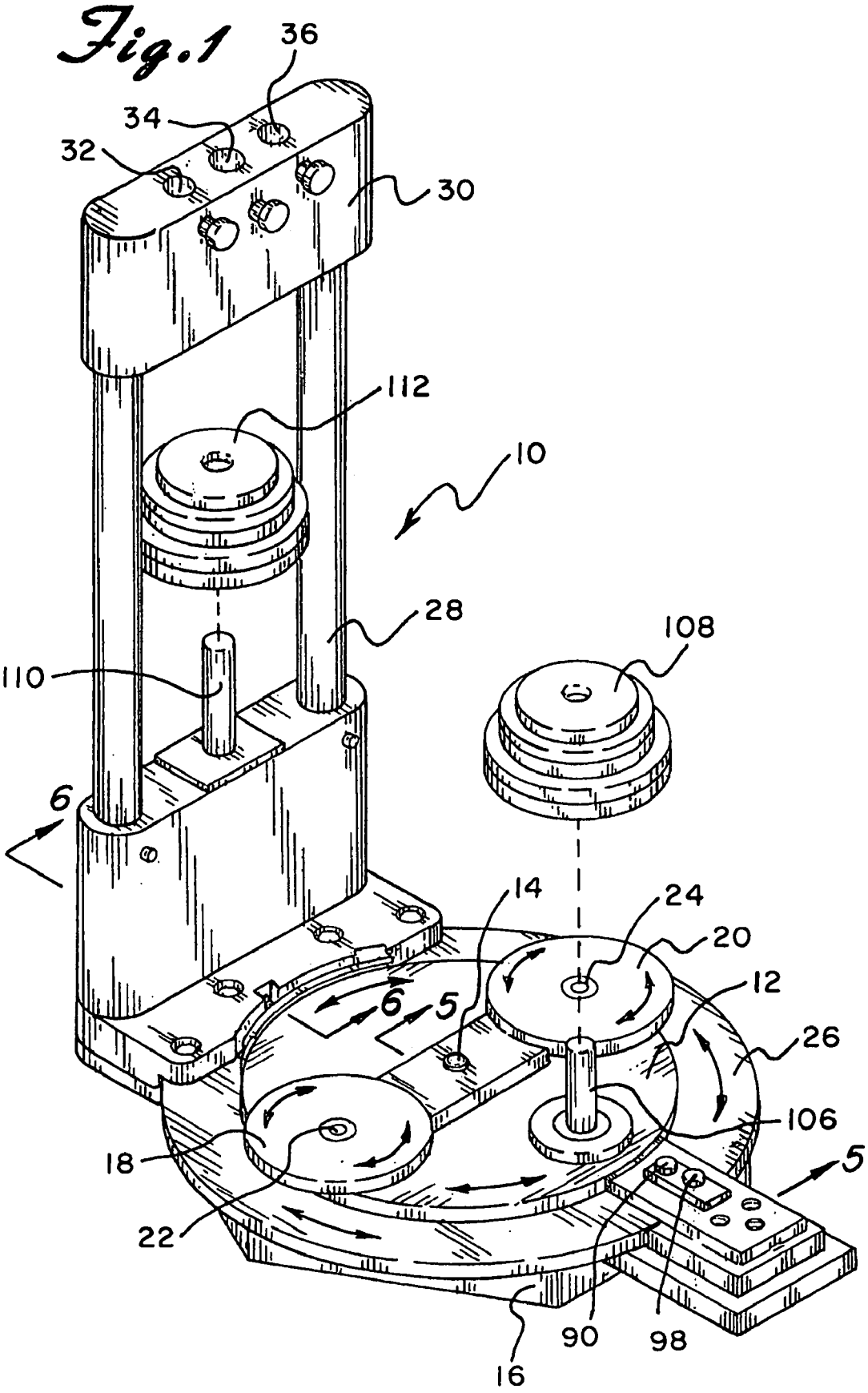
FIG. 1 is a front perspective view of the main portion of the exercise device of the present invention with the handles removed for clarity.

Referring now to the drawings in detail wherein like reference numerals have been used throughout the various figures to designate like elements, there is shown in FIG. 1 an exercise device constructed in accordance with the principles of the present invention and designated generally as 10.

The exercise device of the present invention essentially includes a base or platform, means for rotating a person's lower body and means for rotating a person's upper body. The means for rotating the upper body and the means for rotating the lower body may operate independently of each other.

More specifically, the means for rotating the person's lower body includes first base member 12 that may be mounted for rotation about vertical axis 14 with respect to the base or platform 16. Foot disks 18 and 20 are mounted on the first base member 12 so as to rotate relative thereto about substantially vertical axis 22 and 24, respectively. In use, a person wishing to exercise stands on the foot disks 18 and 20 and can rotate his or her body in a clockwise or counterclockwise direction relative to the floor while allowing his or her feet to pivot as a result of the rotation of the foot disks 18 and 20.

While the first base member 12 and the foot disks 18 and 20 are mounted so as to be rotatable, there may be times during certain exercises when it is desirable to totally prevent or limit their rotation. This can be accomplished by the use of pins and mating apertures formed in the disks 18 and 20 and in the first base member 12 and in the platform 16 as is more fully explained and illustrated in Applicant's parent application referred to above. The entire content of the prior application is incorporated herein by reference. As a result, the person exercising can choose whether to allow either the first base member 12 or either of the foot disks 18 and 20 to rotate or to be fixed against rotation independently of the other elements. The pins and apertures are, of course, only one example of a means for preventing or limiting rotation. Numerous alternative methods will be readily apparent to those skilled in the art.

Figure 2:
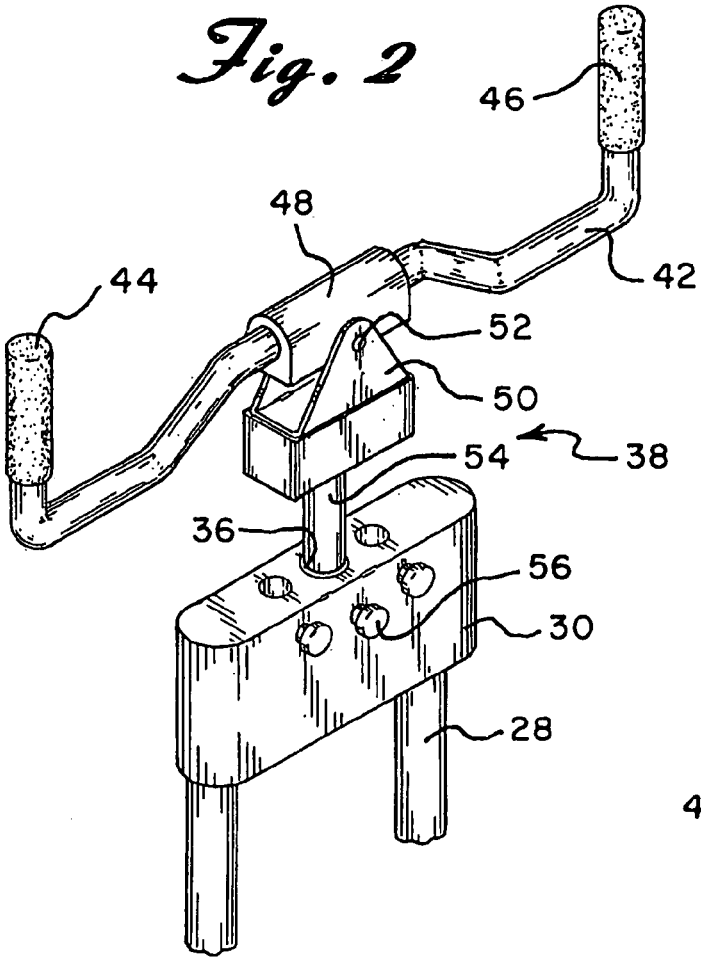
FIG. 2 is a front perspective view of a first form of handle useful with the invention.
Figure 4:
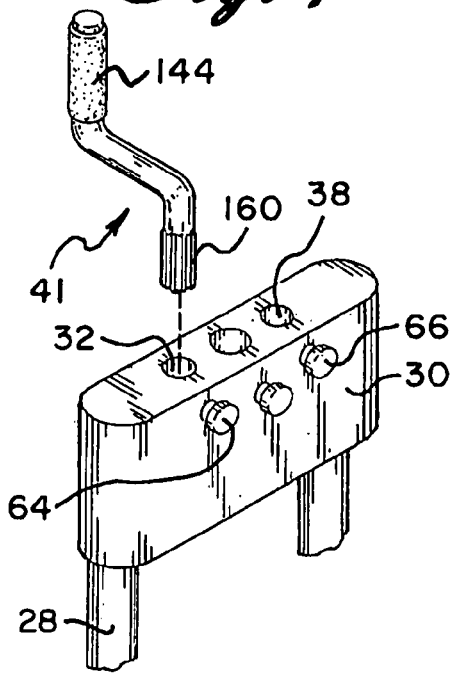
FIG. 4 is a front perspective view of a third form of handle useful with the invention.
Figure 5:
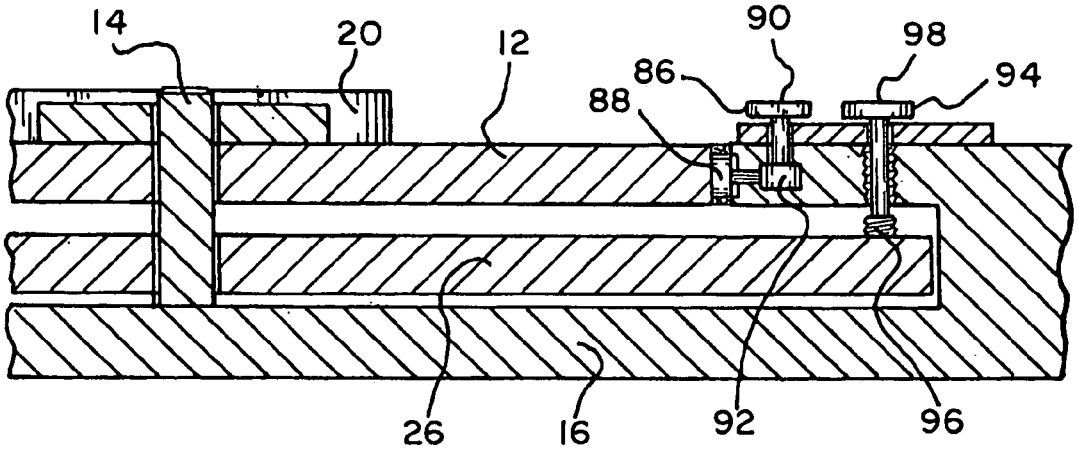
FIG. 5 is a cross-sectional view taken through line 5-5 of FIG. 1.
Figure 3:
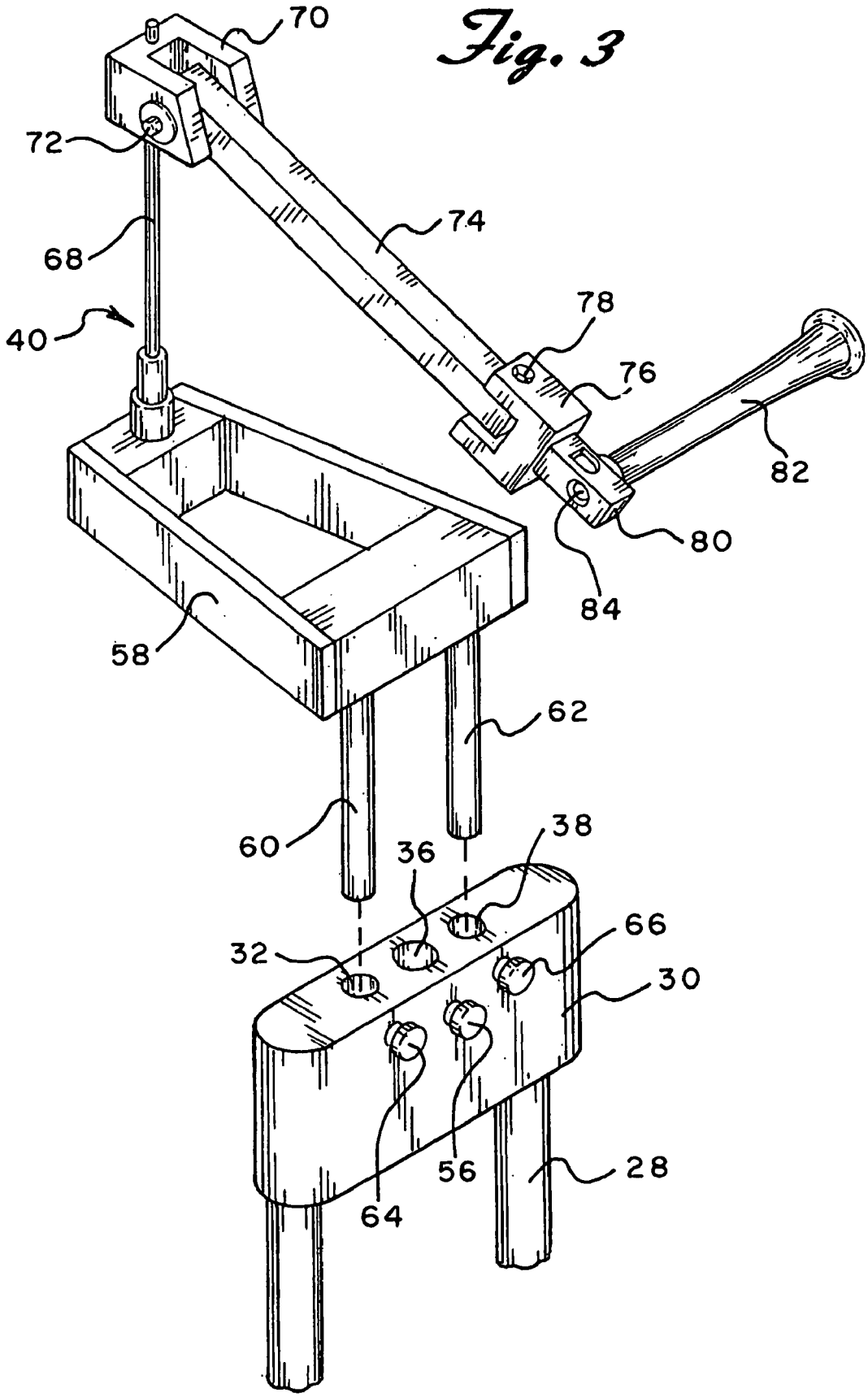
FIG. 3 is a front perspective view of a second form of handle useful with the invention.
Figure 6:
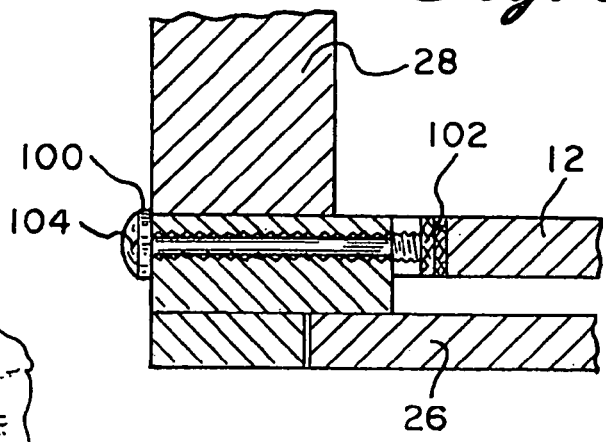
FIG. 6 is a cross-sectional view taken through line 6-6 of FIG. 1

The means for rotating the person's upper body includes a second base member 26 mounted to the base 16 for rotation about vertical axis 14. The second base member 26 is preferably disk shaped although other shapes are possible. Mounted on so as to be moveable therewith and extending upwardly from the second base member 26 is a column or handle support 28. Secured to the top of the column or handle support 28 is a block 30 having three vertical openings 32, 34 and 36 formed therein to support first handle means 38 (FIGS. 2 and 7), second handle means 40 (FIG. 3) or third handle means 41 (FIG. 4).

First handle means 38 includes a handle bar 42 that terminates in handle grips 44 and 46, respectively, at its ends that are adapted to be gripped by the person exercising. The handle bar 42 is carried by a journal 48 that may allow for rotation of the bar 42 about a horizontal axis defined by the center of the journal 48. In turn, the journal 48 is mounted to the U-shaped bracket 50 for limited pivotal movement about horizontal axis 52. The bracket 50 includes a downwardly extending rod 54 that is adapted to be inserted into the vertical opening 36 in the center of the block 30 of the handle support 28. The rod 54 can be locked in place using the knob 56 that is treaded into the block and which engages the rod 54. The rod 54 may also be allowed to freely rotate about it own vertical axis which is significantly offset from the vertical axis 14 about which the first and second base members 12 and 26 rotate. As a result of the foregoing arrangement, the handle grips 44 and 46 are free to rotate or revolve in numerous directions and in various planes.

The second handle means 40 can be employed in lieu of the first handle means 38 and is used to simulate the swinging of a baseball bat. The second handle means 40 includes a frame 58 having a pair of downwardly extending rods 60 and 62 at the front thereof that are adapted to fit within the openings 32 and 38 of the block 30. They can be maintained in place and at the proper height through the use of locking knobs 64 and 66 that operate similar to the knob 56.

Extending upwardly from the rear end of the frame 58 is a rod 68 which carries a U-shaped connector 70 at the top thereof. Pivoted to the U-shaped connector 70 at pivot point 72 and extending forwardly is bar 74. As should be readily apparent to those skilled in the art, the connector 70 acts as a gimbal to allow for movement of the bar 74 in essentially any direction and in any plane. A second gimbal 76 is pivoted to bar 74 at pivot point 78 and has a small standoff block 80 mounted to the end thereof so as to freely rotate about the axis of the bar 74. A handle 82 that resembles the handle end of a baseball bat is, in turn, rotationally mounted at 84 to the block 80.

Figure 7:
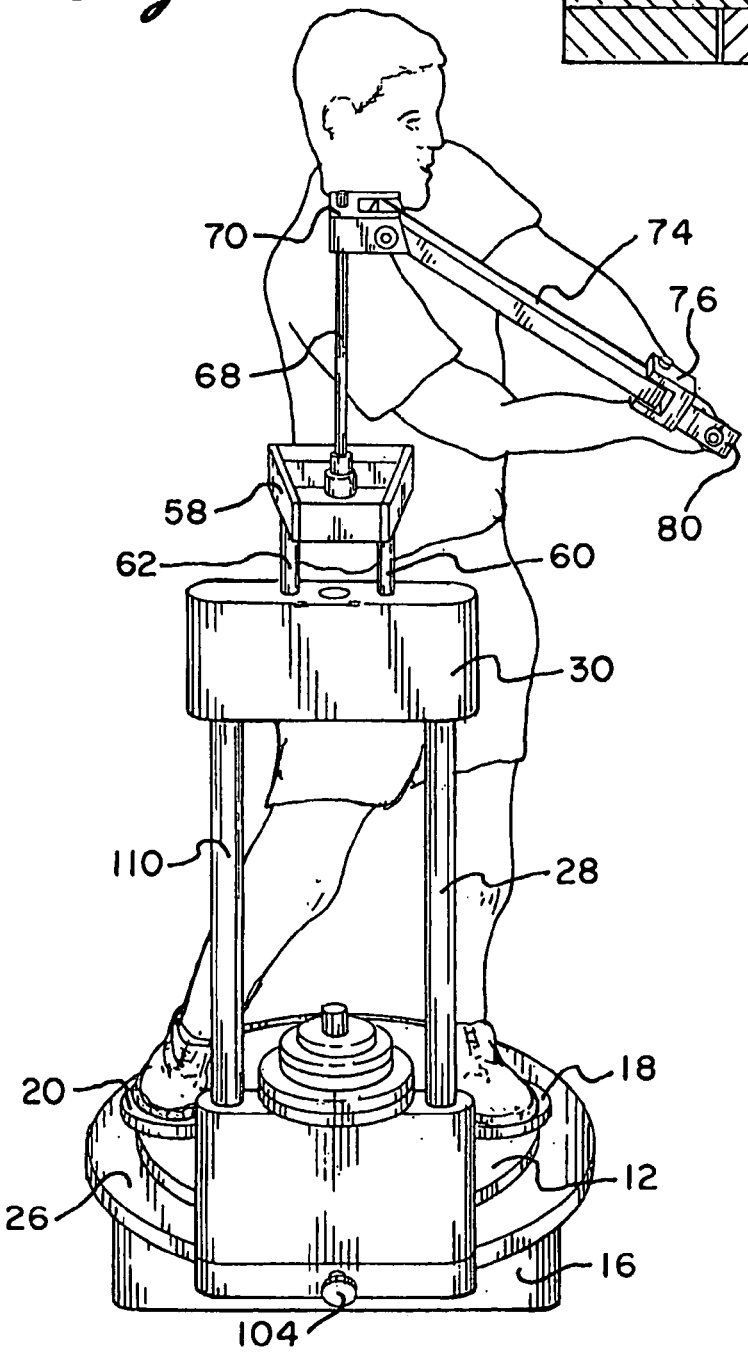
FIG. 7 illustrates the exercise device of the present invention being used to simulate the swinging of a baseball bat.

As can best seen in FIG. 7, the various rotational and pivotal linkages that make up the second handle means 40 in combination with the movement of the disks and the handle support 28 allow a person using the exercise device of the present invention to simulate a baseball swing. This is, of course, by way of example only. By adjusting the height and lengths of the various components of the second handle means 40, it may also be possible to simulate the swing of a tennis racquet or a golf club or other similar devices.

The third handle means 41 is the simplest of the three and is comprised of a pair of crank shaped handles, only one of which is shown in FIG. 4, it being understood that the other third handle means is identical thereto. The third handle means 41 includes a lower portion 160 that is adapted to be inserted into the vertical opening 32 (or 38) in the block 30. Preferably, the position or angle of the handle means 41 can be adjusted and fixed using the locking knob 64 (or 66). To help prevent movement of the handle means 41, the lower portion may have a plurality of ribs formed thereon. As with the first handle means 38, the actual handle portions at the top may include cushions or grips 144 thereon to make it easier for a person to hold. As should be apparent to those skilled in the art, the two handle means 41 can be inserted into the openings 32 and 36 and adjusted to be at the same angle relative the block 30 (and the user) or can be arranged a different angles, as desired.

Although the second base member 26 is mounted for rotation, means may be provided for preventing rotation thereof which may be desirable for certain exercises. As with the first base member 12 and the foot disks 18 and 20, the second base member may have a pin that passes through an aperture and into another aperture in the base 16.

The exercise device 10 may also be provided with means for retarding movement of one or both of the base members in order to increase the force needed by the person exercising to rotate the base members. Three such retarding or braking means are shown. One can be used to vary the resistance between the first base member 12 and the platform 16. The second adjusts the resistance between the second base member 26 and the platform 16 and the third controls the resistance between the first and second base members. They are all constructed in a similar manner.

For example, a brake 86 may be provided at the base 16 adjacent the periphery of the first base member 12. The brake 86 includes a brake shoe 88 that is adapted to press against the edge of the base member 12. A hand screw 90 can be turned by the person exercising to rotate cam 92 which, in turn, moves the brake shoe against the edge of base member 12 to increase the force of the brake shoe 88 against the base member 12 in order to increase or decrease the amount of resistance to motion of the base member 12 relative to the platform 16.

A second brake 94 also mounted on the platform 16 includes a brake shoe 96 that is adapted to engage the top edge of the base member 26. The hand screw 98 can be turned to increase or decrease the force and, therefore, the resistance on the base member 26.

The third brake 100 is mounted at the lower end of the handle support 28 and, therefore, moves with the handle support and with the base member 26 to which the handle support is attached. This third brake member 100 also includes a brake shoe 102 that presses against the outer peripheral edge of the base member 12 through the use of the hand screw 104. All three brakes 86, 94 and 100 can be as loose as desired whereby there is no resistance applied to fully engaged whereby there is no movement allowed between the parts.

The invention also includes means for increasing or decreasing the inertia or momentum of the movement of the base members 12 and 26. This makes it easier or harder to accelerate or decelerate the movement of the base members during exercising as desired and is accomplished utilizing weights. Adjacent the outer edge of the base member 12 and extending upwardly is a weight support bar 106. One or more standard weights 108 can be stacked on the weight bar 106, as desired. Similarly, weight support bar 110 is mounted on the handle support 28 so as to move with the second base member 26. One or more standard weights 112 can be stacked on the weight bar 110, as desired.

The present invention may be embodied in other specific forms without departing from the spirit or essential attributes thereof and accordingly, reference should be made to the appended claims rather than to the foregoing specification as indicating the scope of the invention.

I claim:

1. An exercise device comprising:

a first base member upon which a person exercising may stand;

a second base member rotatable independently of said first base member about a first vertical axis which intercepts said first base member;

handles fixed to and extending upwardly from said second base member and being adapted to be grasped by said person while standing on said first base member, said handles being moveable with said second base member about said first vertical axis.

2. The exercise device of claim 1 wherein said handle means are moveable about a horizontal axis that lies above said first base member.

3. The exercise device of claim 1 including means for adding weights to said second base member to increase the inertia thereof.

4. The exercise device of claim 1 further including first and second foot disks, said disks being mounted on said first base member in such a way that each foot disk is capable of rotating independently of the other disk and relative to said first base member.

5. The exercise device of claim 4 further including means for preventing said foot disks from rotating relative to said first base member.

6. The exercise device of claim 1 further including means for retarding movement of said second base member.

7. The exercise device of claim 1 wherein said second base member is mounted adjacent said first base member and concentric therewith and wherein said handle means extend upwardly so as to be grasped by said person.

8. The exercise device of claim 1 wherein said handle means are moveable about a second vertical axis that is not coaxial with said first vertical axis.

9. An exercise device comprising:

a first base member upon which a person exercising may stand, said first base member being fixed so as not to rotate;

a second base member located beneath said first base member and being rotatable independently of said first base member about a vertical axis that passes through said first base member, first and second foot disks, said disks being mounted on said first base member so as to be capable of rotating relative to said first base member, said foot disks being located on either side of said vertical axis, and handle means fixed to and extending upwardly from said second base member and being adapted to be grasped by said person while standing on said first base member, said handle means moveable with said second base member.

10. The exercise device of claim 9 further including means for preventing said second base member from rotating.

11. The exercise device of claim 9 wherein said second base member is mounted adjacent said first base member and concentric therewith and wherein said handle means extend upwardly so as to be grasped by said person.

12. An exercise device comprising:

a first base member upon which a person exercising may stand, said first base member being capable of rotating about a first vertical axis;

a second base member rotatable independently of said first base member about a second vertical axis which is in substantial axial alignment with said first said vertical axis;

handle means fixed to and extending upwardly from said second base member and being adapted to be grasped by said person while standing on said first base member, said handle means moveable with said second base member, and means for adding weights to at least one of said base members to increase the inertia thereof.

13. The exercise device of claim 12 including means for adding weights to each of said base members to increase the inertia thereof.

14. The exercise device of claim 13 further including first and second foot disks, said disks being mounted on said first base member so as to be capable of rotating relative to said first base member.

15. The exercise device of claim 14 further including means for preventing said foot disks from rotating relative to said first base member.

16. The exercise device of claim 12 further including means for preventing said first base member from rotating.

17. The exercise device of claim 12 further including means for preventing said second base member from rotating.

18. The exercise device of claim 12 wherein said second base member is mounted adjacent said first base member and concentric therewith and wherein said handle means extend upwardly so as to be grasped by said person.

19. An exercise device comprising:

a first base member upon which a person exercising may stand;

a second base member rotatable independently of said first base member about a first vertical axis which intercepts said first base member;

a handle support fixed to and extending upwardly from said second base member; said handle support supporting a handle having an end resembling the handle of a sports bat or racquet and being adapted to be grasped by said person while standing on said first base member, said handle support being moveable with said second base member about said first vertical axis.

20. The exercise device of claim 19 wherein said handle is moveable about a horizontal axis that lies above said first base member and is moveable about a second vertical axis that is not coaxial with said first vertical axis.

21. The exercise device of claim 19 further including first and second foot disks, said disks being mounted on said first base member in such a way that each foot disk is capable of rotating independently of the other disk and relative to said first base member.

* * * * *